United States Patent [19]

Yanoh

[11] 4,189,889

[45] Feb. 26, 1980

[54] SHAPED METALLIC ROOFING PLATE

[76] Inventor: Tomoo Yanoh, 3-1-7, Eifuku, Suginami-ku, Tokyo, Japan

[21] Appl. No.: 887,177

[22] Filed: Mar. 16, 1978

[51] Int. Cl.[2] ..... E04D 1/34; E04D 1/36

[52] U.S. Cl. ..... 52/530; 52/533; 52/553

[58] Field of Search ..... 52/530, 519, 520, 518, 52/529, 531–535, 553–555

[56] References Cited

U.S. PATENT DOCUMENTS

| | | | |
|---|---|---|---|
| 2,380,398 | 7/1945 | Booth | 52/530 |
| 3,412,517 | 11/1968 | Ellis et al. | 52/533 X |
| 3,759,007 | 9/1973 | Thiele | 52/533 |

FOREIGN PATENT DOCUMENTS

| | | | |
|---|---|---|---|
| 251844 | 1/1967 | Austria | 52/530 |
| 722345 | 11/1965 | Canada | 52/530 |
| 1402422 | 8/1975 | United Kingdom | 52/519 |

*Primary Examiner*—J. Karl Bell

*Attorney, Agent, or Firm*—Arthur T. Fattibene

[57] ABSTRACT

A shaped metallic roofing plate having a plurality of tile-shaped metallic rectangular elements adapted to be superposed at their upper and lower edges and side edges. Each rectangular element has a substantially S-sectioned bend formed along the upper edge thereof and a downward bend formed along the lower edge. The upper bend has a plurality of nailing surfaces extending in parallel with the roof surface and occupying a common plane. In assembling, the elements are nailed at their nailing surfaces to the roof surface such that the lower bend of the overlying element is placed and superposed to the upper bend of the underlying element. At one side edge portion of the element, there is formed is at least one groove extending in the direction of slope of the roof. When the other side edge portion of the adjacent element is placed on the side edge portion of the fixed element, a space is formed between the lower surface of the other side edge of the adjacent element and the top surface of the one side edge of the fixed element, thereby to prevent the possible capillary action.

4 Claims, 6 Drawing Figures

SHAPED METALLIC ROOFING PLATE

BACKGROUND OF THE INVENTION

1. Field of the Invention

The present invention relates to a shaped metallic roofing plate having a plurality of rectangular metallic roof-tile-shaped rectangular plate elements which are adapted to be laid successively one on another at their upper and lower edges and side edges to form a roof.

2. Description of the Prior Art

Conventional roofing plates of the known kind have suffered from such a disadvantage that the durability thereof is deteriorated because of a poor watertightness at the marginal edges at which the rectangular plate elements are laid one on another and at portions of the rectangular plate units where nails pass to fix the latter to the roof surface.

SUMMARY OF THE INVENTION

It is therefore an object of the invention to provide a metallic shaped roofing plate capable of overcoming above stated problem of the prior art and featuring reduced weight, good physical strength and easy attachment to the roof.

To this end, according to the invention, there is provided an improved metallic shaped roofing plate having a plurality of rectangular elements adapted to be laid one on another at their adjacent edges, characterized in that a substantially S-sectioned bend is formed at the upper edge of the rectangular element, while a downward bend is formed at the lower edge of the same, such that the S-sectioned bend at the upper edge of one rectangular element is put beneath the downward bend of the overlying rectangular element.

The above and other objects, as well as advantageous features of the invention will become clear from the following description of the preferred embodiments taken in conjunction with the accompanying drawings.

DESCRIPTION OF THE PREFERRED EMBODIMENTS

Figure 1:
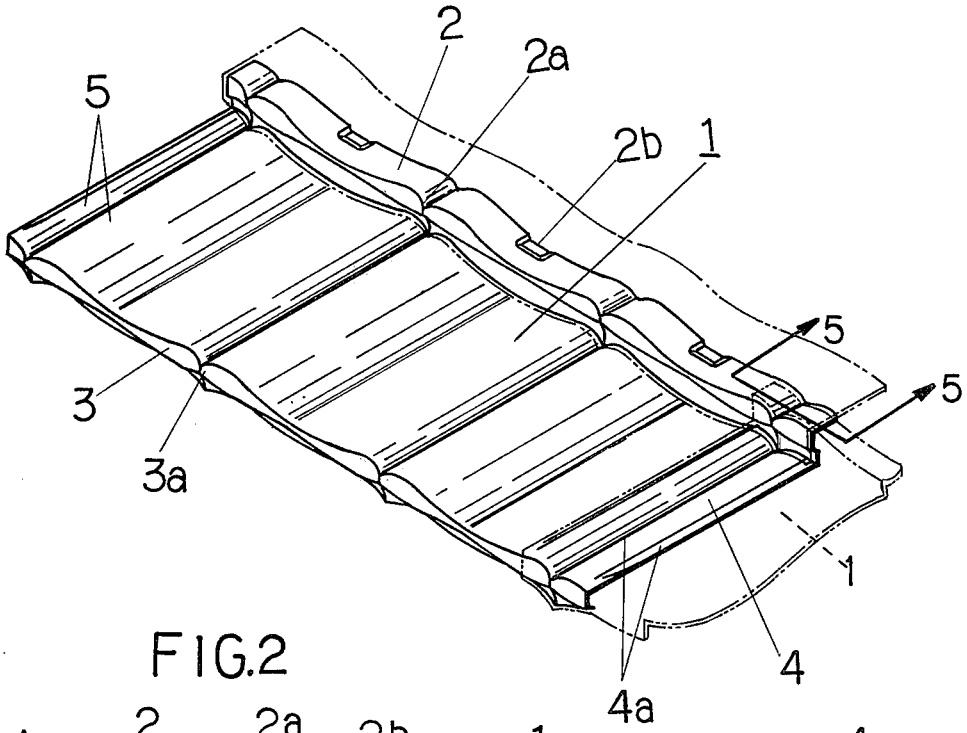
FIG. 1 is a perspective view of a roofing plate embodying the present invention.
Figure 3:
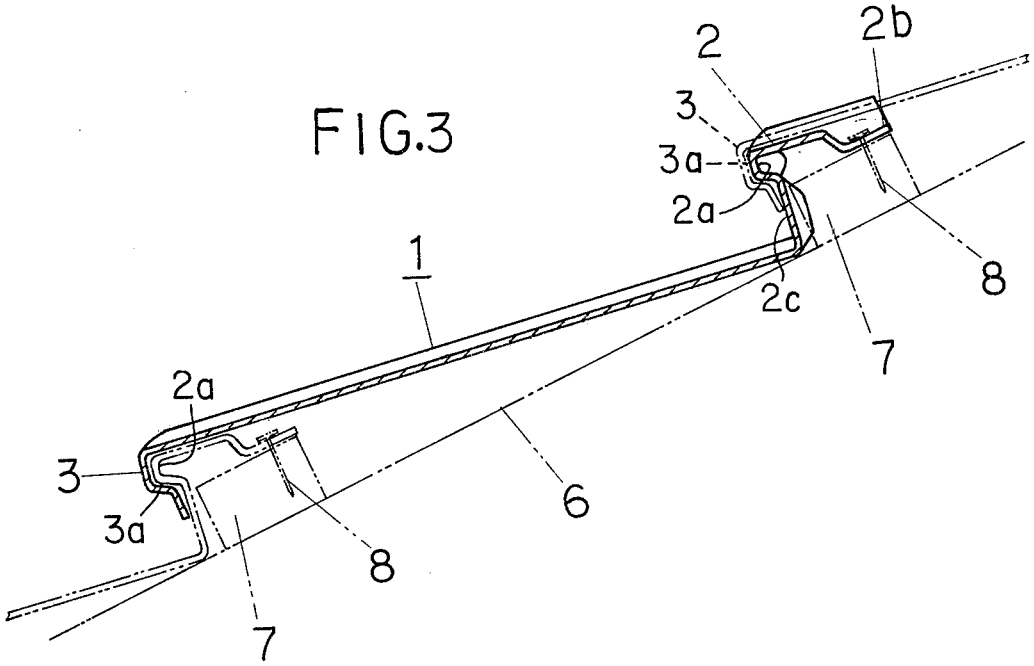
FIG. 3 is a sectional view taken along the line A—A of FIG. 2.

Referring first to FIG. 1, the roofing plate of the invention has a plurality of metallic rectangular elements 1. The metallic rectangular element or body portion 1 is shaped from a plate of a metallic material such as zinc-plated iron, copper, aluminum and the like into a form of a roofing tile. FIG. 1 shows exemplarily an example of the rectangular element 1 shaped in the form of three tiles positioned in side-by-side relation. At the upper marginal edge of the rectangular body element, a substantially S-sectioned bend 2 including generally upwardly extending portion 2*c* terminating in a forwardly extending projection having a reverse bend, as shown in FIG. 3, is formed to extend over entire breadth of the element, while, at the lower marginal edge of the rectangular element, a downward bend 3 having a complementary extending projection is formed over entire breadth of the element to extend in parallel with and to complement the bend 2. In assembling, the rectangular elements are placed such that the bottom surface of the bend 3 of the overlying element as shown by two-dots-and-dash line in FIG. 1 is put on the top of the bend 2 of the underlying element, so that these bends 2, 3 are superposed. Thus, the bend 2 makes a surface contact with the bend 3, in such a manner as to show a substantially S-shaped section as shown in FIG. 3.

Figure 2:
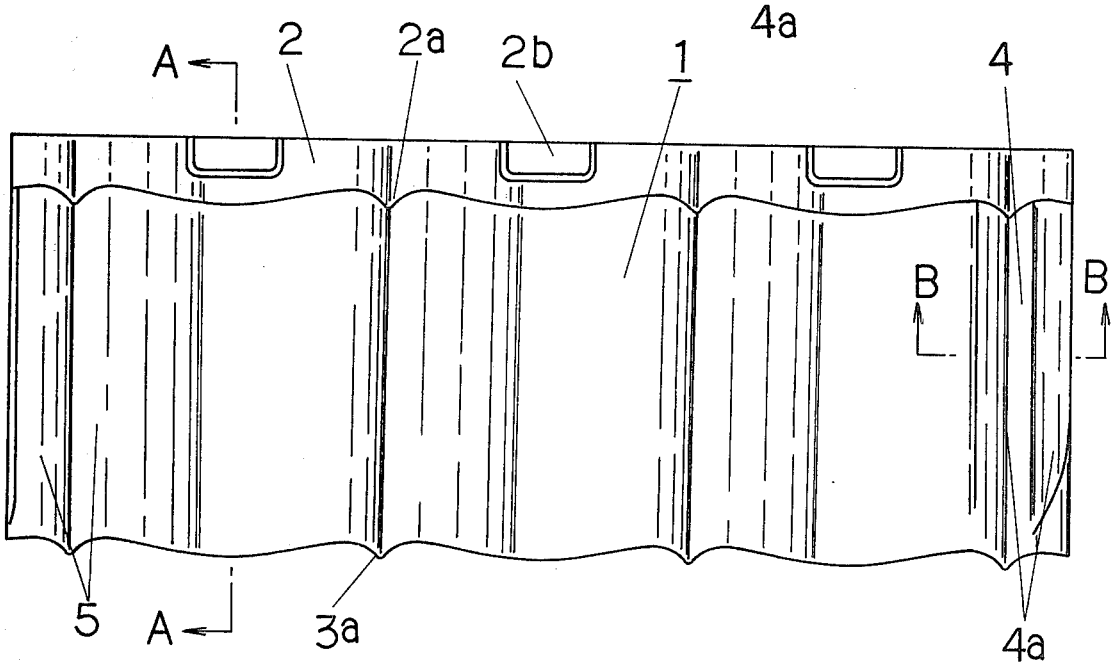
FIG. 2 is a plan view of the roofing plate as shown in FIG. 1.

As will be seen from FIG. 2, projections 2*a* . . . are formed on the bend 2, while corresponding projections 3*a* . . . are formed on the bend 3. The arrangement is such that the projections 3*a* . . . engages the projections 2*a* . . . when the bottom surface of the bend 3 of an overlying rectangular element 1 is placed on the top of the bend 2 of the underlying element 1.

Preferably, a large number of projections 2*a* . . . and 3*a* . . . are formed on the vertical and horizontal portions of the bends 2 and 3, respectively, such that the projections 2*a* . . . make surface contact with corresponding projections 3*a* . . . .

Nailing surfaces 2*b* are formed on the top surfaces of the bends 2, so as to extend in parallel with the roof surface, occupying a common plane.

Figure 4:
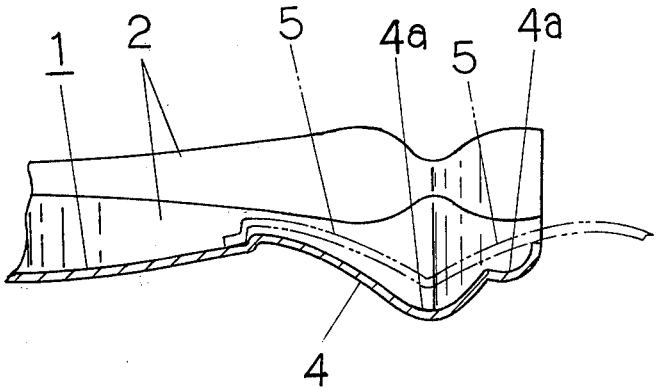
FIG. 4 is a sectional view taken along the line B—B of FIG. 4.
Figure 6:
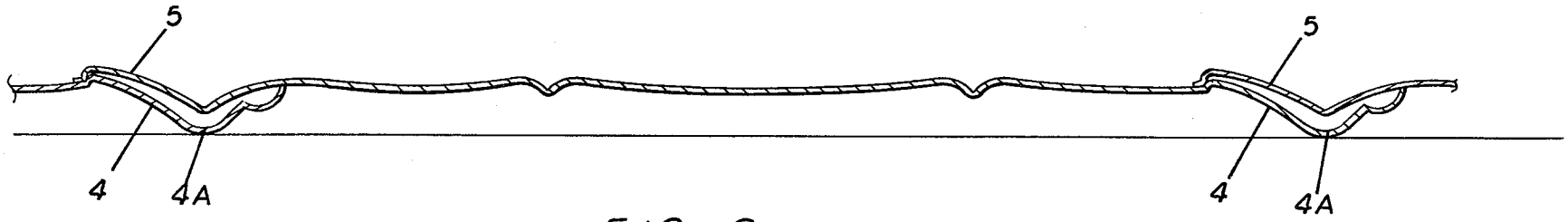
FIG. 6 is a sectional view taken longitudinally through adjacent overlapping roofing plates embodying the invention.
Figure 5:
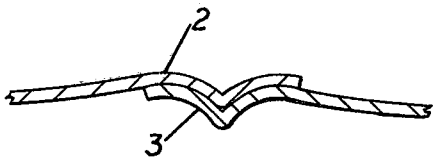
FIG. 5 is a sectional view taken along line 5—5 on FIG. 1.

At one side edge portion 4 of the element 1, there is formed a substantially V-sectioned bent vertical groove 4*a* . . . extending in parallel with the side edge. As shown by two-dots-and-chain line in FIG. 1, the bottom surface of the other edge 5 of the adjacent rectangular element 1 is placed on the top surface of the side edge 4 of the element 1, in such a manner that the bottom surface of the edge 5 makes linear contacts with both end ridges of the bent vertical groove 4*a* . . . , so as to form a cavity as shown in FIG. 4 at each portion of the bent vertical grooves 4*a* . . . .

In attaching the rectangular element to the roof of a building, the element is placed such that the bottom surfaces of the nailing surfaces or flanges 2*b* . . . formed on the bend 2 are placed on a bar 7 extending at right angle to the direction of inclination of the roof surface 6. Then, the rectangular element is anchored by means of nails 8 . . . . Since the nailing surfaces 2*b* . . . are formed to extend in parallel with the roof surface, as shown in FIG. 3, the rectangular element can be stably secured to the latter through the bar 7. Then, the overlying rectangular element 1 is put on the fixed element 1 in such a manner that the bottom surface of the bend 3 of the overlying element 1 is placed on the top surface of the bend 2 of the fixed element 1, i.e. the underlying element 1. The overlying element 1 is then fixed to the roof surface in the same manner as the underlying element 1. In this state, as will be seen from FIG. 3, the overlapping portions of the bend 2 of the underlying element 1 and the bend 3 of the underlying element 1 make a surface contact with each other, exhibiting an S-shaped section, so as to prevent rainwater and the like from coming into the back side of the elements 1 and to check the capillary action which would, for otherwise, act to invite the water into the backside space of the elements.

At the same time, the bend 3 of the overlying rectangular element 1 is prevented from being turned upward, by the anchoring performed by the S-sectioned portion of the underlying element 1. Thus, a sufficiently large strength of the roofing plate is obtained easily by simply securing the rectangular elements by means of nails 8 . . . through the nailing surfaces. In addition, the nailing surfaces *2b* . . . are conveniently covered by the bend 3 of the overlying rectangular element 1, so as to protect the nail from corrosion against rainwater, and so as to preserve an attractive appearance.

Further, since the projections *2a* . . . formed on the bend 2 fit the projections *3a* . . . of the bend 3, the lateral displacement of the rectangular elements from each other is fairly avoided. The physical strength of the roofing plate will be enhanced by forming a number of projections *2a* and corresponding number of projections *3a*.

Further, when the adjacent rectangular element 1 is anchored to the roof surface 6 with its other side edge 5 placed on the top of the one side edge 4 of the previously anchored element 1, the bottom surface of the edge portion 5 makes linear contacts with the ridges at both sides of the bent vertical grooves *4a* . . . , so as to produce cavities along the valleys of the grooves *4a* . . . , as shown in FIG. 4. That is to say, the bottom surface of the edge portion 5 does not make a surface contact with the top surface of the edge portion 4, so that no capillary action takes place between these edge portions. Further, even if the rainwater happens to get into the gap between these edges, the invading rainwater is made to flow downward along the vertical grooves *4a* . . . , and does never stay on the roofing plate.

As has been described, according to the invention, a good durability of the roofing plate is ensured by the enhanced watertightness at the overlapping portions of the rectangular elements and at the nailing portions, and by the improved physical strength. Further, the invention brings about various other advantages such as improved appearance.

Having described a preferred embodiment of the invention, it is to be noted here that various changes and modifications may be imparted thereto, without departing from the scope of the invention which is limited solely by the appended claims.

What is claimed is:

1. A roofing plate comprising:

a water impervious element having a body portion, and a connected upper edge portion, a lower edge portion, and opposed side edge portions circumscribing said body portion, said upper edge portion having a generally upwardly extending portion terminating in a forwardly extending projection having a reverse bend, said reverse bend defining a nail flange, said lower edge portion including a longitudinally extending depending flange having a complementary extending projection for complementing the forwardly extending projection of the upper edge portion of a like adjacent roofing plate, and the respective opposed side edges of said plate include a transversely extended groove extending parallel to its respective side edge whereby said opposed side edge portion complements one another so that in the assembled position of like roofing plates, the groove formed adjacent one edge portion of one plate overlies the groove formed adjacent the other end portion of a like roofing plate in spaced relationship to define flow channel therebetween to prohibit any capilliary action from occurring between overlying side edge portions of adjacent roofing plates, wherein said nailing flange is located at an elevation above said surface of the body portion.

2. A roofing plate as defined in claim 1 wherein the groove extending parallel to one side edge portion thereof is deeper than the groove extending parallel to the other side edge portion thereof so that in the assembled portion, the side edge portion having the shallower groove overlies the side edge portion of an adjacent roofing plate having the deeper groove.

3. A roofing plate as defined in claim 1 whereby the under surface of the side edge portion of one roofing plate is adapted to rest in overlying relation on the ridges defining the groove along the opposite side edge portion of an adjacent roofing plate.

4. A roofing plate comprising:

a water impervious element having a body portion, and a connected upper edge portion, a lower edge portion, and opposed side edge portions circumscribing said body portion, said upper edge portion having a generally upwardly extending portion terminating in a forwardly extending projection having a reverse bend, said reverse bend defining a nailing flange, said lower edge portion including a longitudinally extending depending flange having a complementary extending projection for complementing the forwardly extending projection of the upper edge portion of a like adjacent roofing plate, and the respective opposed side edges of said plate include a transversely extended groove extending parallel to its respective side edge whereby said opposed side edge portion complements one another so that in the assembled position of like roofing plates, the groove formed adjacent one edge portion of one plate overlies the groove formed adjacent the other end portion of a like roofing plate in spaced relationship to define flow channel therebetween to prohibit any capilliary action from occuring between overlying side portions of adjacent roofing plates, wherein said upwardly extending portion of said upper edge portion is adapted to abutt against a nailing bar.

* * * * *